US005765539A

United States Patent [19]

Isobe et al.

[11] Patent Number: 5,765,539

[45] Date of Patent: Jun. 16, 1998

[54] EVAPORATIVE FUEL-PROCESSING SYSTEM FOR INTERNAL COMBUSTION ENGINES

[75] Inventors: Takashi Isobe; Hiroshi Yatani, both of Wako, Japan

[73] Assignee: Honda Giken Kogyo Kabushiki Kaisha, Tokyo, Japan

[21] Appl. No.: 832,190

[22] Filed: Apr. 8, 1997

[30] Foreign Application Priority Data

Apr. 26, 1996 [JP] Japan ..... 8-131409

[51] Int. Cl.[6] ..... F02M 27/04

[52] U.S. Cl. ..... 123/520; 123/198 D

[58] Field of Search ..... 123/520, 198 D, 123/521, 518, 519, 516

[56] References Cited

U.S. PATENT DOCUMENTS

| | | | |
|---|---|---|---|
| 5,143,035 | 9/1992 | Kayanuma | 123/198 D |
| 5,305,724 | 4/1994 | Chikamatsu | 123/198 D |
| 5,333,589 | 8/1994 | Otsuka | 123/198 D |
| 5,355,863 | 10/1994 | Yamanaka | 123/198 D |
| 5,427,075 | 6/1995 | Yamanaka | 123/198 D |
| 5,448,980 | 9/1995 | Kawamura | 123/198 D |
| 5,450,834 | 9/1995 | Yamanaka | 123/198 D |
| 5,463,998 | 11/1995 | Denz | 123/198 D |

FOREIGN PATENT DOCUMENTS 6-323206 11/1994 Japan .

*Primary Examiner*—Carl S. Miller

*Attorney, Agent, or Firm*—Nikaido, Marmelstein, Murray & Oram LLP

[57] ABSTRACT

An evaporative fuel-processing system for an internal combustion engine includes a canister, a charging passage extending between the canister and a fuel tank, a purging passage extending between the canister and the intake system of the engine, an open-to-atmosphere passage for relieving the interior of the canister to the atmosphere, a charge control valve for opening and closing the charging passage, a purge control valve for opening and closing the purging passage, a vent shut valve for opening and closing the open-to-atmosphere passage, and a pressure sensor for detecting pressure within the charging passage. When the engine is in a predetermined operating condition, the interior of the fuel tank is negatively pressurized into a predetermined negatively pressurized state by opening the purge control valve and the charge control valve and closing the vent shut valve. When a predetermined time period has elapsed from the start of the negative pressurization before the interior of the fuel tank is set to the predetermined negatively pressurized state, the purge control valve and the charge control valve are closed, and an abnormality of the fuel tank is determined based on the pressure detected by the pressure sensor immediately before and after the closing of the purge control valve and the charge control valve.

3 Claims, 9 Drawing Sheets

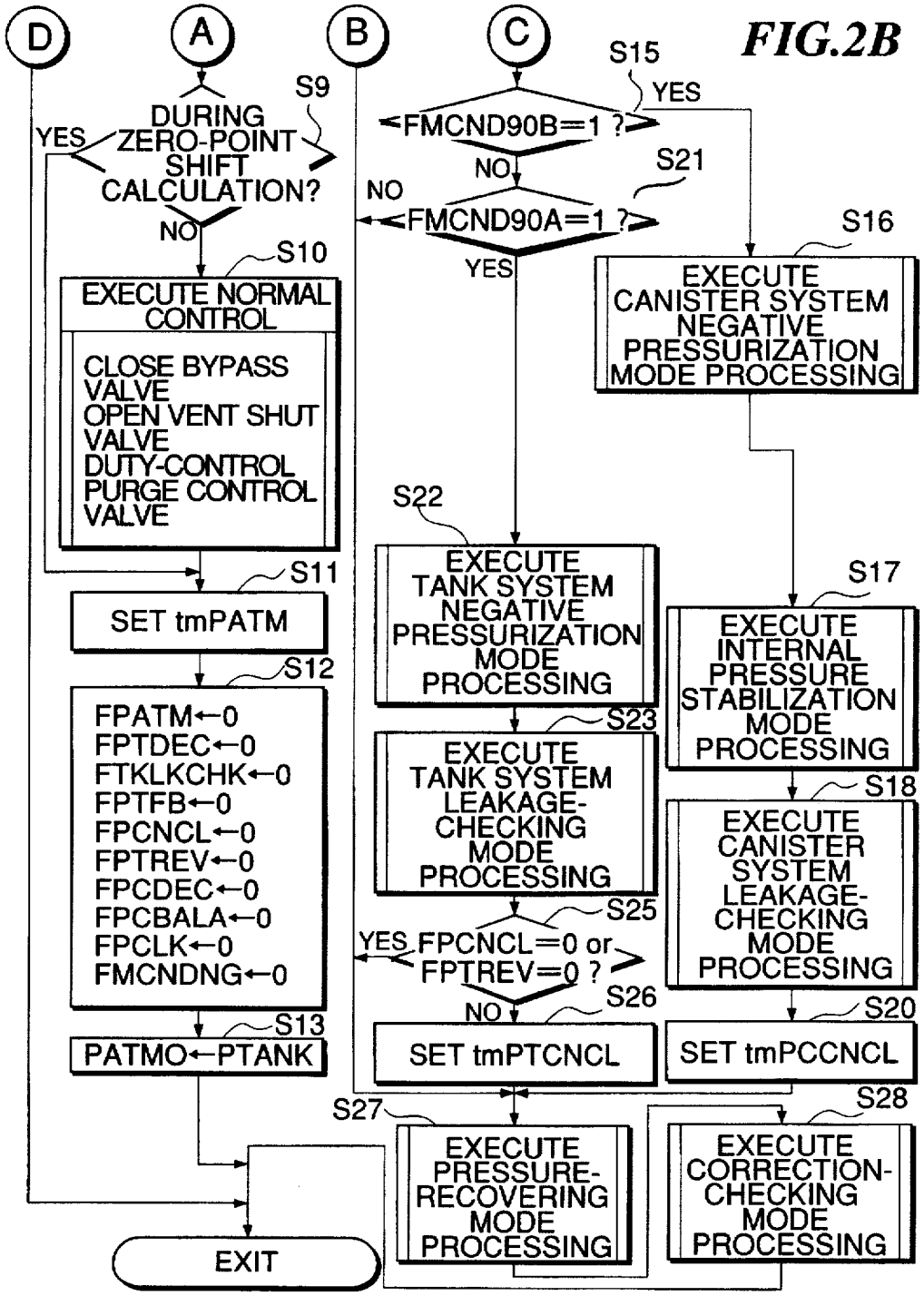
FIG.2B
D
A
B
C
S9
DURING ZERO-POINT SHIFT CALCULATION?
YES
NO
S10
EXECUTE NORMAL CONTROL
CLOSE BYPASS VALVE
OPEN VENT SHUT VALVE
DUTY-CONTROL PURGE CONTROL VALVE
S11
SET tmPATM
S12
FPATM←0
FPTDEC←0
FTKLKCHK←0
FPTFB←0
FPCNCL←0
FPTREV←0
FPCDEC←0
FPCBALA←0
FPCLK←0
FMCNDNG←0
S13
PATMO←PTANK
EXIT
S15
FMCND90B=1 ?
YES
NO
S21
FMCND90A=1 ?
NO
YES
S16
EXECUTE CANISTER SYSTEM NEGATIVE PRESSURIZATION MODE PROCESSING
S22
EXECUTE TANK SYSTEM NEGATIVE PRESSURIZATION MODE PROCESSING
S23
EXECUTE TANK SYSTEM LEAKAGE-CHECKING MODE PROCESSING
S25
FPCNCL=0 or FPTREV=0 ?
YES
NO
S26
SET tmPTCNCL
S17
EXECUTE INTERNAL PRESSURE STABILIZATION MODE PROCESSING
S18
EXECUTE CANISTER SYSTEM LEAKAGE-CHECKING MODE PROCESSING
S20
SET tmPCCNCL
S27
EXECUTE PRESSURE-RECOVERING MODE PROCESSING
S28
EXECUTE CORRECTION-CHECKING MODE PROCESSING

EVAPORATIVE FUEL-PROCESSING SYSTEM FOR INTERNAL COMBUSTION ENGINES

BACKGROUND OF THE INVENTION

1. Field of the Invention

This invention relates to an evaporative fuel-processing system for internal combustion engines, which stores evaporative fuel generated in the fuel tank and purges the same into the intake system of the engine when the engine is in a predetermined suitable operating condition, and more particularly to an evaporative fuel-processing system of this kind, which has a function of determining abnormality in an evaporative emission control system of the engine.

2. Prior Art

Conventionally, there is known an evaporative fuel-processing system for internal combustion engines, for example, from Japanese Laid-Open Patent Publication (Kokai) No. 6-323206, which includes a fuel tank, a canister for adsorbing evaporative fuel generated in the fuel tank, a charging passage connecting between the canister and the fuel tank, a purging passage connecting between the canister and the intake system of the engine, an open-to-atmosphere passage for communicating the interior of the canister with the atmosphere, a charge control valve arranged across the charging passage, for selectively opening and closing the same, a purge control valve arranged across the purging passage, for selectively opening and closing the same, a vent shut valve arranged across the open-to-atmosphere passage, for selectively opening and closing the same, and a pressure sensor for detecting pressure within the fuel tank. According to the conventional evaporative fuel-processing system, abnormality of the fuel tank is determined in the following manner:

1) Before negative pressurization of the interior of the fuel tank, the charge control valve is consecutively opened and closed, to thereby detect a rate of change in an output from the pressure sensor;

2) The purge control valve and the charge control valve are opened and the vent shut valve is closed, to thereby negatively pressurize the interior of the fuel tank (Negative Pressurization); and 3) In the case where a predetermined time period has elapsed before the interior of the fuel tank is brought into a predetermined negatively pressurized state, the rate of change detected above) is compared with a predetermined amount. If the former is smaller than the latter, that is, if an amount of evaporative fuel generated in the fuel tank is small, it is determined that the fuel tank is abnormal.

According to the conventional manner, however, if the purge control valve is deteriorated due to aging such that the flow rate of evaporative fuel through the valve becomes smaller, the following inconvenience arises: That is, upon opening of the purge control valve, the flow rate does not increase to a sufficient level, so that a rate of decrease in the pressure within the fuel tank is small. As a result, even when the fuel tank is normal, the predetermined time period can elapse before the fuel tank is brought into the predetermined negatively pressurized state, resulting in a misjudgment that the fuel tank is abnormal.

SUMMARY OF THE INVENTION

It is the object of the invention to provide an evaporative fuel-processing system for internal combustion engines, which is capable of carrying out abnormality determination of the fuel tank with accuracy even if the rate of negative pressurization of the interior of the fuel tank lowers due to aging deterioration of the purge control valve.

To attain the object, the present invention provides an evaporative fuel-processing system for an internal combustion engine having a fuel tank, and an intake system, including a canister for adsorbing evaporative fuel generated in the fuel tank, a charging passage extending between the canister and the fuel tank, a purging passage extending between the canister and the intake system, an open-to-atmosphere passage for relieving an interior of the canister to atmosphere, a charge control valve for opening and closing the charging passage, a purge control valve for opening and closing the purging passage, a vent shut valve for opening and closing the open-to-atmosphere passage, and a pressure sensor arranged in the charging passage on a side of the charge control valve closer to the fuel tank, for detecting pressure within the charging passage.

The evaporative fuel-processing system is characterized by the improvement comprising:

negatively pressurizing means operable when the engine is in a predetermined operating condition, for negatively pressurizing an interior of the fuel tank into a predetermined negatively pressurized state by opening the purge control valve and the charge control valve and closing the vent shut valve; and abnormality-determining means operable when a predetermined time period has elapsed from the start of the negative pressurization before the interior of the fuel tank is set to the predetermined negatively pressurized state, for closing the purge control valve and the charge control valve, and determining an abnormality of the fuel tank, based on the pressure within the charging passage detected by the pressure sensor immediately before and after the closing of the purge control valve and the charge control valve.

Preferably, the abnormality-determining means determines that the fuel tank is abnormal when the pressure within the charging passage detected by the pressure sensor has increased by a predetermined amount or more from a value thereof detected by the pressure sensor immediately before the closing of the purge control valve and the charge control valve, within a second predetermined time period from the closing of the purge control valve and the charge control valve.

Also preferably, the abnormality-determining means determines an abnormality of the fuel tank, based on a rate of change in the pressure within the charging passage detected by the pressure sensor over a third predetermined time period, when no abnormality of the fuel tank has been detected.

The above and other objects, features, and advantages of the invention will be more apparent from the following detailed description taken in conjunction with the accompanying drawings.

BRIEF DESCRIPTION OF THE DRAWINGS

FIG. 2B is a continued part of the flowchart of FIG. 2A;

DETAILED DESCRIPTION

The invention will now be described in detail with reference to the drawings showing an embodiment thereof.

Figure 1:
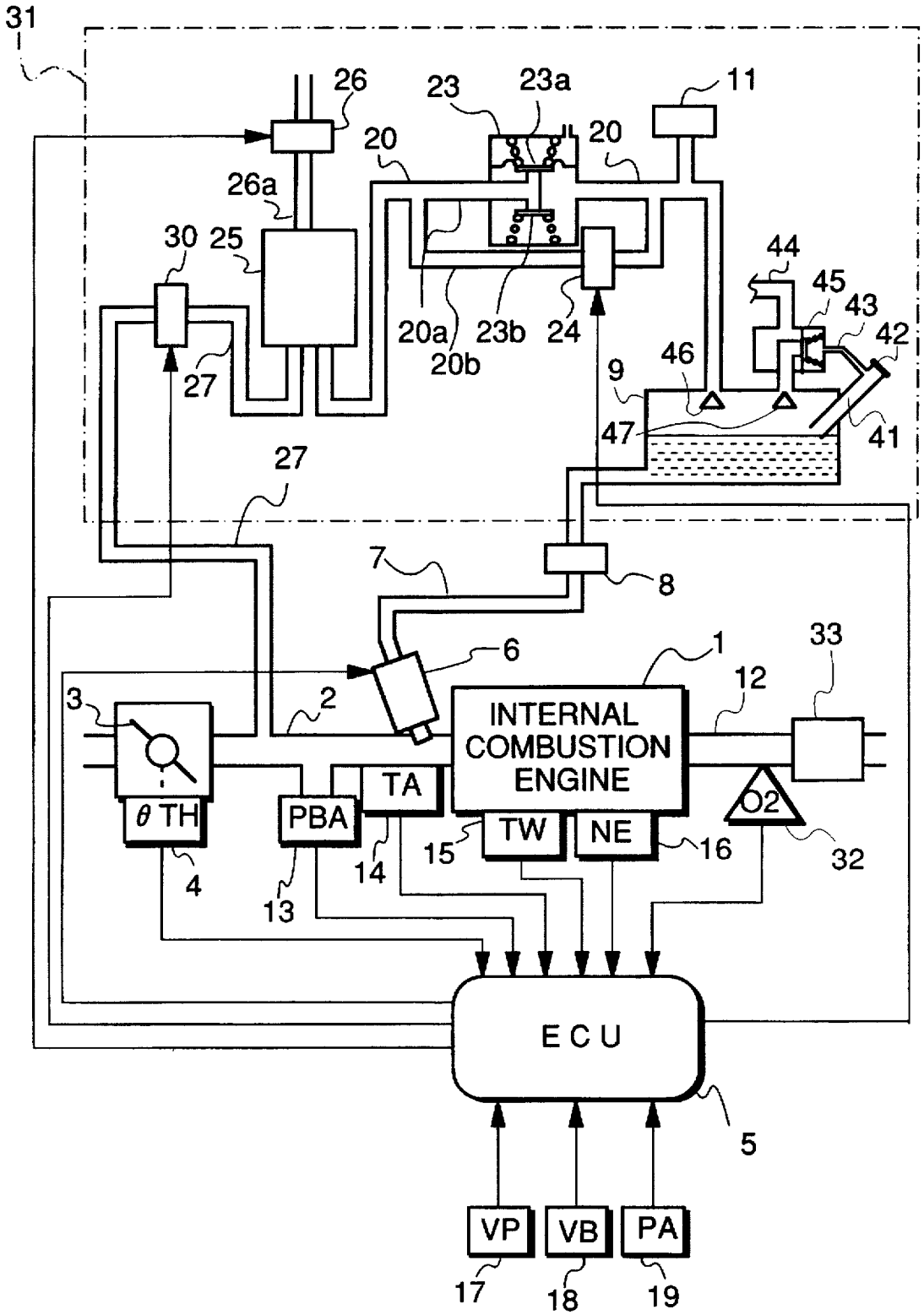
FIG. 1 is a block diagram schematically showing the whole arrangement of an internal combustion engine and an evaporative fuel-processing system therefor, according to an embodiment of the invention.

Referring first to FIG. 1, there is illustrated the whole arrangement of an internal combustion engine, an evaporative emission control system and a control system therefor, according to an embodiment of the invention.

In the figure, reference numeral 1 designates an internal combustion engine (hereinafter simply referred to as "the engine") having four cylinders, not shown, for instance. Connected to the cylinder block of the engine 1 is an intake pipe 2, in which is arranged a throttle valve 3. A throttle valve opening (θTH) sensor 4 is connected to the throttle valve 3, for generating an electric signal indicative of the sensed throttle valve opening θTH and supplying the same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3 and slightly upstream of respective intake valves, not shown. The fuel injection valves 6 are connected to a fuel tank 9 via a fuel supply pipe 7 and a fuel pump 8 arranged thereacross. The fuel injection valves 6 are electrically connected to the ECU 5 to have their valve opening periods controlled by signals therefrom.

An intake pipe absolute pressure (PBA) sensor 13 and an intake air temperature (TA) sensor 14 are inserted into the intake pipe 2 at locations downstream of the throttle valve 3. The PBA sensor 13 detects absolute pressure PBA within the intake pipe 2, and the TA sensor 14 detects intake air temperature TA. These sensors supply electric signals indicative of the respective sensed parameters to the ECU 5.

An engine coolant temperature (TW) sensor 15 formed of a thermistor or the like is inserted into a coolant passage formed in the cylinder block, which is filled with an engine coolant, for supplying an electric signal indicative of the sensed engine coolant temperature TW to the ECU 5.

An engine rotational speed (NE) sensor 16 is arranged in facing relation to a camshaft or a crankshaft of the engine 1, neither of which is shown. The NE sensor 16 generates a signal pulse as a TDC signal pulse at each of predetermined crank angles whenever the crankshaft rotates through 180 degrees, the signal pulse being supplied to the ECU 5.

Arranged in an exhaust pipe 12 is an O2 sensor 32 as an exhaust gas component concentration sensor for detecting the concentration VO2 of oxygen present in exhaust gases from the engine, and generating a signal indicative of the sensed oxygen concentration VO2 to the ECU 5. Further, a three-way catalyst 33 is arranged in the exhaust pipe 12 at a location downstream of the O2 sensor 32, for purifying exhaust gases emitted from the engine 1.

Further electrically connected to the ECU 5 are a vehicle speed sensor 17 for detecting the traveling speed VP of an automotive vehicle in which the engine 1 is installed, a battery voltage sensor 18 for detecting output voltage VB from a battery, not shown, of the engine, and an atmospheric pressure sensor 19 for detecting atmospheric pressure PA, of which respective output signals indicative of the sensed parameter values are supplied to the ECU 5.

Next, an evaporative emission control system (hereinafter referred to as "the emission control system") 31 will be described, which is comprised of the fuel tank 9, a charging passage 20, a canister 25, a purging passage 27, etc.

The fuel tank 9 is connected to the canister 25 via the charging passage 20 which has a bifurcated portion consisting of first and second divided passages **20*a* and 20*b* arranged in an engine compartment, not shown. A pressure sensor 11 is inserted in the charging passage 20 at a location intermediate between the divided passages 20*a* and 20*b* and the fuel tank 9, for detecting pressure PTANK within the charging passage 20**. The pressure PTANK is almost equal to the pressure within the fuel tank, and will therefore be referred to as "the tank internal pressure" hereinafter.

The fuel tank 9 has a filler tube 41 provided at a tip thereof with a filler cap 42, and is connected to the canister 25 through a refueling charging passage 44, only part of which is shown. The refueling charging passage 44 is larger in cross sectional area than the charging passage 20 and hence supply a large amount of evaporative fuel generated at refueling to the canister 25. Arranged across the charging passage 44 is a diaphragm valve 45 which is connected via a passage 43 to a portion of the filler tube 41 in the vicinity of an oil-inlet end thereof. The diaphragm valve 45 opens to open the charging passage 44 only during refueling.

Provided in the fuel tank 9 are first and second float valves 46 and 47 which are arranged at ends of the respective charging passages 20 and 44 opening into the fuel tank 9. The float valves 46 and 47 close to close the charging passages 20 and 44 when the fuel tank 9 is fully charged with fuel or when it is tilted, to thereby prevent liquid fuel from flowing into the charging passages 20 and 44.

The first divided passage **20*a* is provided with a two-way valve 23 arranged thereacross. The two-way valve 23 is a mechanical valve formed of a positive pressure valve 23*a* which opens when the tank internal pressure PTANK is higher than the atmospheric pressure by approximately 20 mmHg or more, and a negative pressure valve 23*b* which opens when the tank internal pressure PTANK is lower than pressure within the charging passage 20 on one side of the two-way valve 23 closer to the canister 25** by a predetermined amount or more.

The second divided passage **20*b* is provided with a bypass valve 24 arranged thereacross, which is a normally-closed electromagnetic valve, and is selectively opened and closed during execution of abnormality determination, described hereinafter, by a signal from the ECU 5**.

The canister 25 contains activated carbon for adsorbing evaporative fuel, and has an air inlet port, not shown, communicating with the atmosphere via a passage **26*a*. Arranged across the passage 26*a* is a vent shut valve 26 which is a normally-open electromagnetic valve and is temporarily closed during execution of the abnormality determination, by a signal from the ECU 5**.

The canister 25 is connected via the purging passage 27 to the intake pipe 2 at a location downstream of the throttle valve 3. The purging passage 27 has a purge control valve 30 arranged thereacross. The purge control valve 30 is an electromagnetic valve which is adapted to continuously change the flow rate of a mixture of evaporative fuel and air as the on/off duty ratio of a control signal supplied thereto from the ECU 5 is changed.

The ECU 5 is comprised of an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU"), a memory circuit storing operational programs executed by the CPU and for storing results of calculations therefrom, etc., and an output circuit which outputs driving signals to the fuel injection valves 6, bypass valve 24, and purge control valve 30.

The CPU of the ECU 5 operates in response to the above-mentioned various engine operating parameter signals from the various sensors to determine operating conditions in which the engine 1 is operating, such as an air-fuel ratio feedback control region where the air-fuel ratio is controlled in response to the oxygen concentration VO2 in exhaust gases detected by the O2 sensor 32, and air-fuel ratio open-loop control regions, and calculates, based upon the determined engine operating conditions, a fuel injection period Tout over which each fuel injection valve 6 is to be opened, in synchronism with generation of TDC signal pulses, by the use of the following equation (1):

$$Tout=Ti\times K1\times KO2+K2 \quad (1)$$

where Ti represents a basic value of the fuel injection period Tout of the fuel injection valve 6, which is read from a Ti map determined according to the engine rotational speed NE and the intake pipe absolute pressure PBA.

KO2 represents an air-fuel ratio correction coefficient which is determined based on the oxygen concentration VO2 in exhaust gases detected by the O2 sensor 32 when the engine 1 is operating in the air-fuel ratio feedback control region, while it is set to predetermined values corresponding to the respective operating regions of the engine when the engine 1 is in the air-fuel ratio open-loop control regions.

K1 and K2 represent other correction coefficients and correction variables, respectively, which are set according to engine operating parameters to such values as optimize engine operating characteristics, such as fuel consumption and engine accelerability.

Figure 2A:
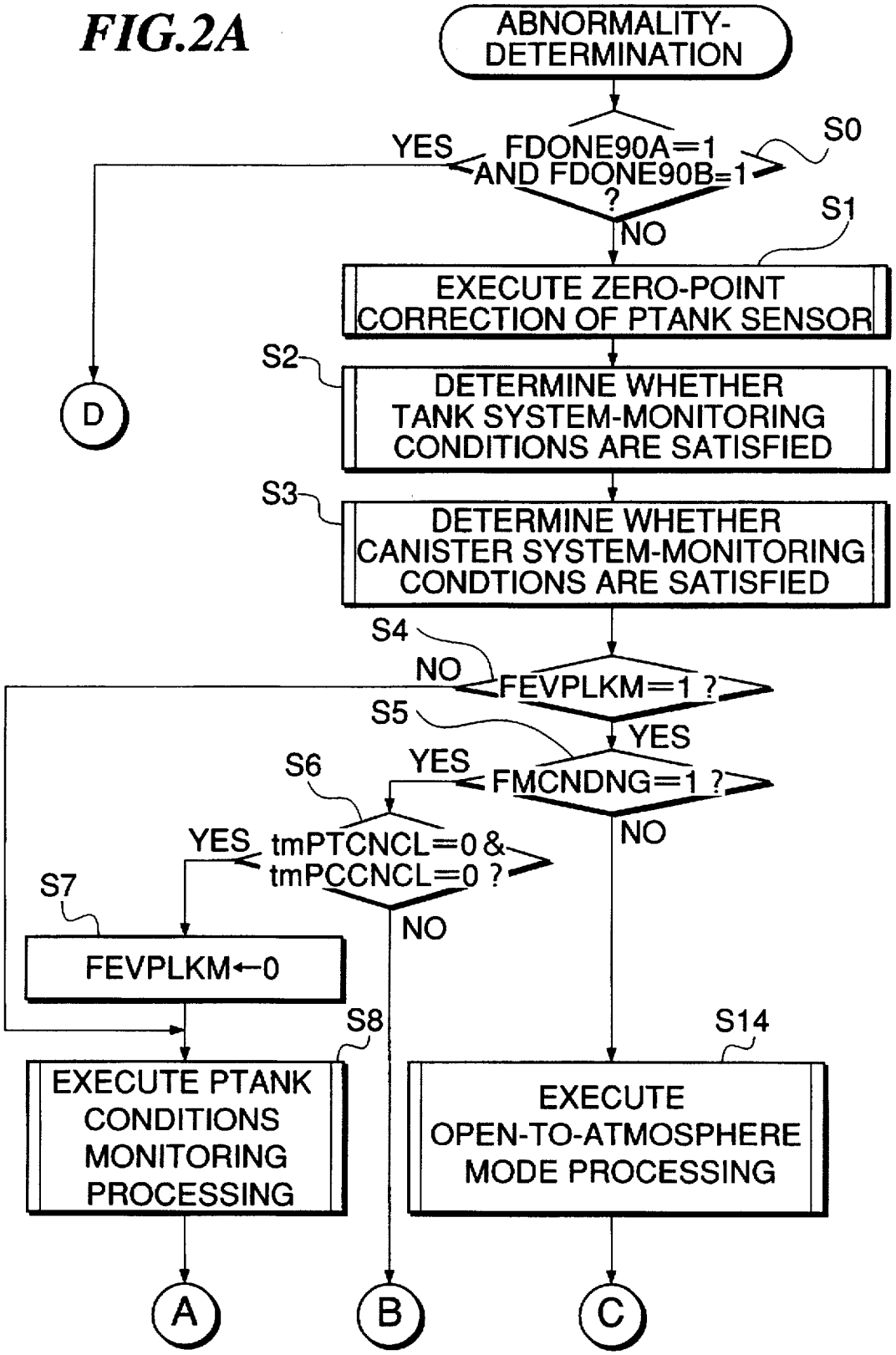
FIG. 2A is a flowchart showing a main routine for carrying out abnormality determination of an evaporative emission control system appearing in FIG. 1.

The abnormality determination of the evaporative emission control system 31 is carried out by the CPU of the ECU 5. FIGS. 2A and 2B show a main routine for carrying out the abnormality determination, which is executed at predetermined time intervals (e.g. 80 msec).

First, at a step SO, it is determined whether or not a tank system-monitoring completion flag FDONE90A and a canister system-monitoring completion flag FDONE90B are both equal to "1". If the flags FDONE90A and DONE90B are both equal to "1", the program is immediately terminated, whereas if the flags FDONE90A and FDONE90B are not both equal to "1", the program proceeds to a step S1. The tank system-monitoring completion flag FDONE90A, when set to "1", indicates that the monitoring for the tank system has been completed, and the canister system-monitoring completion flag FDONE90B, when set to "1", indicates that the monitoring for the canister system has been completed. At the step S1, zero-point correction of the pressure sensor (PTANK sensor) 11 is carried out. More specifically, at the start of the engine, when the intake air temperature TA and the engine coolant temperature TW are within respective predetermined ranges and at the same time the difference between the two values TA and TW is small (at so-called cold starting of the engine), the vent shut valve 26 is opened, the purge control valve 30 is closed, and the bypass valve 24 is opened from its closed position. Then, the zero-point correction of the output value from the sensor 11 is carried out based on a change in an output from the pressure sensor 11 which is caused by the above opening of the bypass valve 24 from its closed position.

At a step S2, it is determined whether or not tank system monitoring conditions (preconditions for permitting abnormality determination as to a tank system) are satisfied. The tank system is defined as a part of the emission control system 31 located on one side of the bypass valve 24 closer to the fuel tank 9. A canister system, referred to hereinbelow, is defined as a part of the emission control system 31 located on the other side of the bypass valve 24 closer to the canister 25. The tank system monitoring conditions are satisfied, for example, when purging is being carried out with the purge control valve 30 opened, the engine is in a predetermined steady operating condition, the vehicle is cruising with a small change in the vehicle speed VP, and at the same time the air-fuel ratio correction coefficient KO2 is larger than a predetermined value and hence the influence of purged evaporative fuel is small. If the tank system monitoring conditions are satisfied, a tank system-monitoring permission flag FMCND90A and a monitoring permission flag FEVPLKM are both set to "1", whereas if the tank system monitoring conditions are not satisfied, the tank system-monitoring permission flag FMCND90A is set to "0". The monitoring permission flag FEVPLKM is set to "1" if canister system monitoring conditions, referred to hereinafter, are satisfied. While the canister system is being monitored, the tank system monitoring conditions are set unsatisfied.

At a step S3, it is determined whether or not the canister system monitoring conditions (preconditions for permitting abnormality determination as to the canister system) are satisfied. The canister system monitoring conditions are satisfied, similarly to the tank system monitoring conditions, when purging is being carried out, the engine is in a predetermined steady operating condition, the vehicle is cruising with a small change in the vehicle speed VP, and at the same time the air-fuel ratio correction coefficient KO2 is larger than a predetermined value and hence the influence of purged evaporative fuel is small. If the canister system monitoring conditions are satisfied, a canister system-monitoring permission flag FMCND90B and the monitoring permission flag FEVPLKM are both set to "1", whereas if the canister system monitoring conditions are not satisfied, the canister system-monitoring permission flag FMCND90B is set to "0". The monitoring permission flag FEVPLKM is set to "1" if the tank system monitoring conditions are satisfied. While the tank system is being monitored, the canister system monitoring conditions are set unsatisfied.

At a step S4, it is determined whether or not the monitoring permission flag FEVPLKM is equal to "1". If FEVPLKM=0 holds, which means that the tank system monitoring conditions and the canister system monitoring conditions are both unsatisfied, the program proceeds to a step S8, wherein tank internal pressure PTANK continuous monitoring processing is carried out.

In the continuous monitoring processing, if an average value of the tank internal pressure PTANK is held at a value close to the atmospheric pressure while the tank internal pressure PTANK has a small change, it is determined that there is an abnormality in the tank system. This method of determination is based on the fact that when the tank system is normal, the tank internal pressure PTANK tends to be higher than the atmospheric pressure by a predetermined amount or more or to be lower than the atmospheric pressure by a predetermined amount or more. This determination is carried out after completion of the zero-point correction of the pressure sensor 11, under a normal control mode in which the bypass valve 24 is closed, the vent shut valve 26 is open, and the purge control valve 30 is duty-controlled, as set at a step S10.

Then, the program proceeds to a step S9 in FIG. 2B, wherein it is determined whether or not a calculation of a zero-point shift of the pressure sensor 11 is being executed. During execution of the calculation of the zero-point shift of the pressure sensor 11, the bypass valve 24 is opened and the purge control valve 30 is closed (while the vent shut valve 26 is open), and therefore the program skips the step S10 over to a step S11. On the other hand, if the calculation is not being carried out, the program proceeds to the step S10, wherein the normal control mode is set, that is, the bypass valve 24 is closed, the vent shut valve 26 is opened, and the purge control valve 30 is duty-controlled, to thereby control an amount of evaporative fuel to be supplied to the intake system 2 of the engine 1.

At the step S1, an open-to-atmosphere timer (down-counting timer) tmPATM for controlling the maximum time period of open-to-atmosphere mode processing, executed at a step S14, is set to a predetermined time period TPATM (e.g. 15 sec) and started.

At a step S12, the following various flags to be used in the present processing are reset. That is, an open-to-atmosphere flag FPATM which, when set to "1", indicates that the open-to-atmosphere mode has been completed, is set to "0". A tank system negative pressurization mode flag FPTDEC which, when set to "1", indicates that tank system negative pressurization mode processing (at a step S22) is to be carried out, is set to "0". A tank system leakage-checking mode flag FTKLKCHK which, when set to "1", indicates that tank system leakage-checking mode processing (at a step S23) is to be carried out, is set to "0". A feedback negative pressurization permission flag FPTFB which, when set to "1", indicates that feedback negative pressurization in the tank system negative pressurization mode is permitted, is set to "0". A pressure-recovering mode flag FPCNCL which, when set to "1", indicates that pressure-recovering mode processing (at a step S27) is to be carried out, is set to "0". A correction-checking mode flag FPTREV which, when set to "1", indicates that correction-checking mode processing (at a step S28) is to be carried out, is set to "0". A canister system negative pressurization mode flag FPCDEC which, when set to "1", indicates that canister system negative pressurization mode processing (at a step S16) is to be carried out, is set to "0". An internal pressure stabilization mode flag FPCBALA which, when set to "1", indicates that internal pressure stabilization mode processing (at a step S17) is to be carried out, is set to "0". A canister system leakage-checking mode flag FPCLK which, when set to "1", indicates that canister system leakage-checking mode processing (at a step S18) is to be carried out, is set to "0". Further, a monitoring-stopping flag FMCNDNG which, when set to "1", indicates that the tank monitoring or the canister monitoring is to be stopped during execution of tank monitoring or canister monitoring (i.e. the pressure-recovering mode) is set to "0".

At the following step S13, the tank internal pressure PTANK detected in the present loop is stored as initial tank internal pressure PATMO, followed by terminating the present routine.

If the tank system monitoring conditions or the canister system monitoring conditions are satisfied, and hence the monitoring permission flag FEVPLKM is equal to "1" at the step S4, the program proceeds to a step S5, wherein it is determined whether or not the monitoring-stopping flag FMCNDNG is equal to "1". If FMCNDNG=1 holds, it is determined at a step S6 whether or not the count values of a tank system pressure-recovering timer (down-counting timer) tmPTCNCL and a canister system pressure-recovering timer (down-counting timer) tmPCCNCL, which are set, respectively, at steps S26 and S20, referred to hereinafter, are both equal to "0". If tmPTCNCL>0 or tmPCCNCL>0 holds, the program proceeds to the step S27. On the other hand, if tmPTCNCCL=0 and tmPCCNCL=0 both hold, the monitoring permission flag FEVPLKM is set to "0" at a step S7, followed by the program proceeding to the step 8.

If FMCNDNG=0 holds at the step S5, which means that the monitoring conditions for the tank system or the canister system are satisfied, the open-to-atmosphere mode processing is executed at the step S14.

More specifically, the purge control valve 30 is closed, and the bypass valve 24 and the vent shut valve 26 are opened, to thereby relieve the canister system and the tank system into the atmosphere over a predetermined time period. After the lapse of the predetermined time period, if the tank system-monitoring permission flag FMCND90A is equal to "1", the tank system negative pressurization mode flag FPTDEC is set to "1", and a down-counting timer tmPRTANK, referred to in the tank system negative pressurization mode processing (at the step S22), is set to a predetermined time period TPRGOP (e.g. 10 sec) for open-loop negative pressurization and started, followed by terminating the open-to-atmosphere mode processing. On the other hand, if the canister system-monitoring permission flag FMCND90B is equal to "1", the canister system negative pressurization mode flag FPCDEC is set to "1", and a down-counting timer tmPRG, referred to in the canister system negative pressurization mode processing (at the step S16), is set to a predetermined time period TPRG and started, followed by terminating the open-to-atmosphere mode processing.

At the following step S15, it is determined whether or not the canister system-monitoring permission flag FMCND90B is equal to "1". If FMCND90B=1 holds, the canister system abnormality determination at the step S16 et seq. is executed.

First, at the step S16, the canister system negative pressurization mode processing is executed. More specifically, the bypass valve 24 is kept open, the vent shut valve 26 is closed, and the purge control valve 30 is duty-controlled, to thereby negatively pressurize the tank internal pressure PTANK to a predetermined value.

At the step S17, the internal pressure-stabilization mode processing is executed. More specifically, the vent shut valve 25 is kept closed, and the bypass valve 24 and the purge control valve 30 are both closed, to thereby maintain the negatively pressurized state over a predetermined time period TPCBALA.

Then, the canister system leakage-checking mode processing is executed at the step S18. More specifically, the vent shut valve 26 and the purge control valve 30 are kept closed, and the bypass valve 24 is opened. Then, if an amount of decrease (PCBALA–PTANK) obtained by subtracting the tank internal pressure PTANK assumed after the lapse of a predetermined time period TPCLK from a tank internal pressure value PCBALA assumed at the start of the leakage-checking mode is smaller than a predetermined value DPCANI, it is determined that the canister system is abnormal. On the other hand, if the amount of decrease exceeds the predetermined value DPCANI before the lapse of the predetermined time period TPCLK, it is determined that the canister system is normal, and then the canister system leakage-checking mode processing is terminated. This determination is based on the fact that if the canister system is normal, the pressure within the canister system assumed at the end of the internal pressure stabilization mode falls, e.g. to approximately –40 mmHg, and accordingly the tank internal pressure PTANK assumed after opening of the bypass valve 24 falls by the predetermined value DPCANI or more due to the fall in pressure within the canister system.

At the following step S20, the canister system pressure-recovering timer tmPCCNCL, referred to at the step S6, is set to a predetermined time period TPCCNCL (e.g. 0.1 sec) and started, followed by the program proceeding to the step S27.

If FMCND90B=0 holds at the step S15, it is determined at a step S21 whether or not the tank system-monitoring permission flag FMCND90A is equal to "1". If FMCND90A=0 holds, the program jumps to the step S27. On the other hand, if FMCND90A=1 holds, the tank system abnormality determination is carried out by executing the step S22 (tank system negative pressurization mode processing) and the step S23 (tank system leakage-checking mode processing).

Figure 3A:
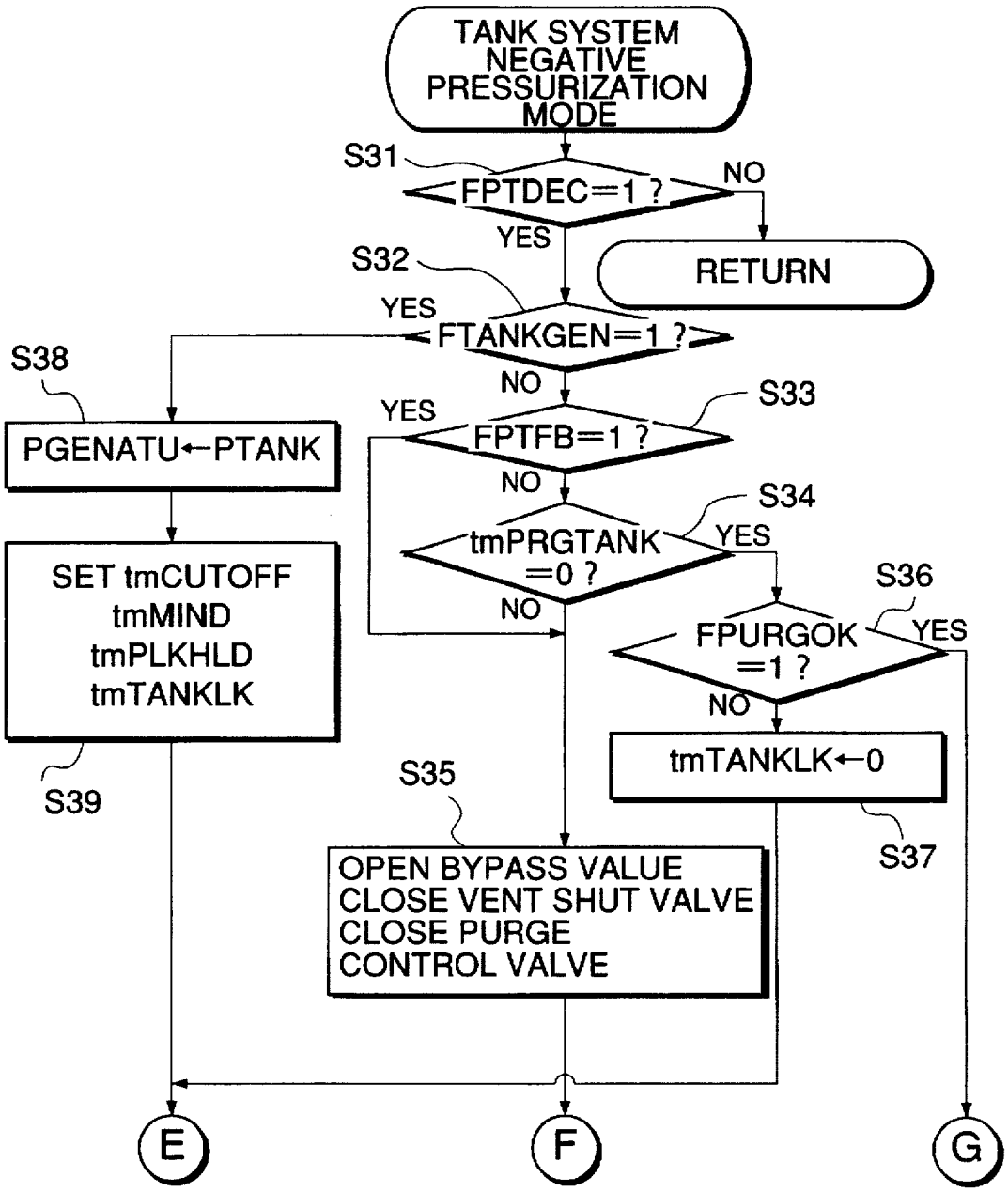
FIG. 3A is a flowchart showing a subroutine for carrying out negative pressurization mode processing of a tank system appearing in FIG. 1, which is executed at a step S22 in FIG. 2B.
Figure 3B:
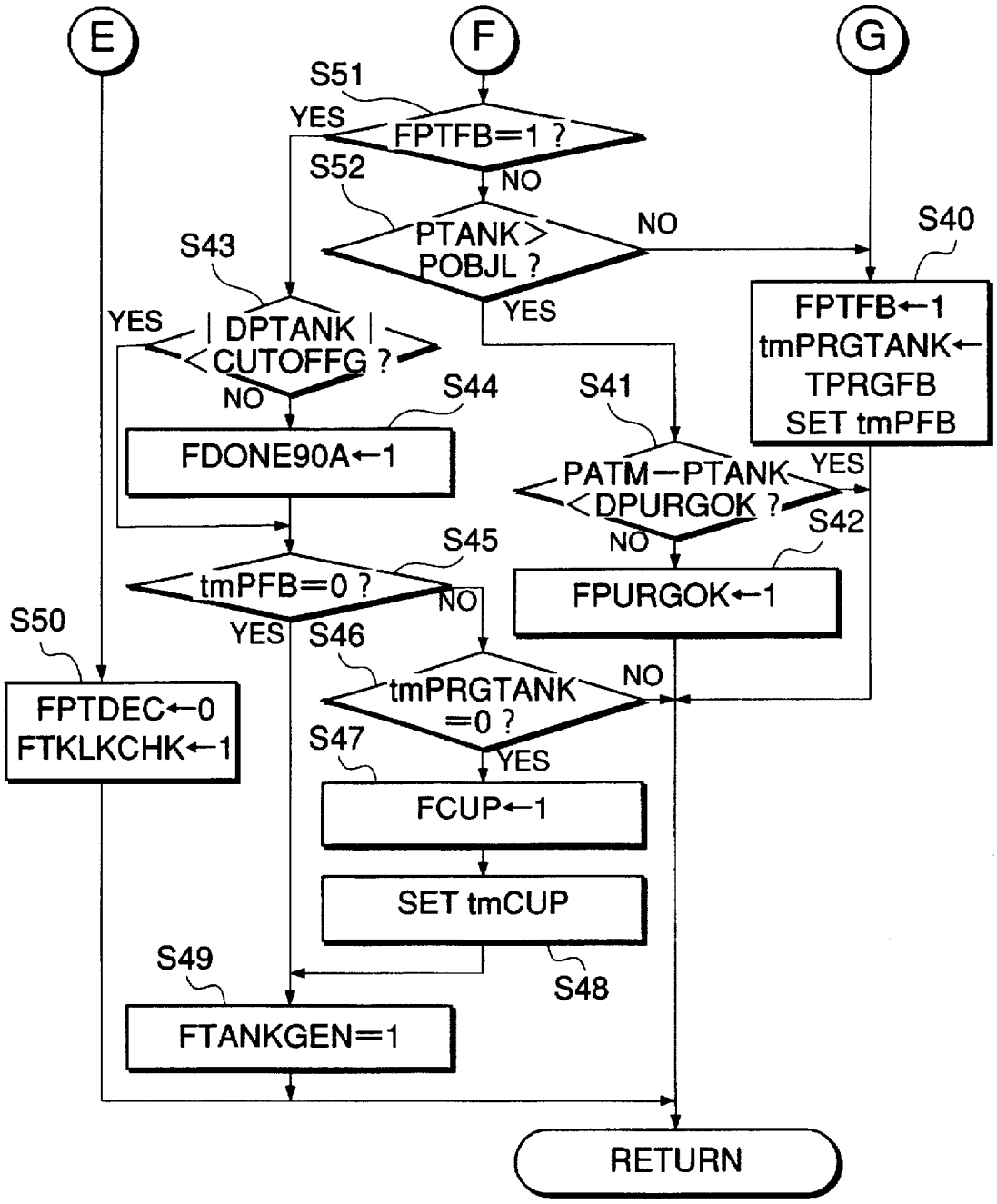
FIG. 3B is a continued part of the flowchart of FIG. 3A.

FIGS. 3A and 3B show a subroutine for carrying out the tank system negative pressurization mode processing executed at the step S22 in FIG. 2B.

At a step S31, it is determined whether or not the tank system negative pressurization mode flag FPTDEC is equal to "1". If FPTDEC=0 holds, the program is immediately terminated. On the other hand, if FPTDEC=1 holds, a tank system negative pressurization completion flag FTANKGEN (see a step S49) is equal to "1" at a step S32. The flag FTANKGEN, when set to "1", indicates that the tank system negative pressurization has been completed. When this question is first made, FTANKGEN=0 holds, and then the program proceeds to a step S33, wherein it is determined whether or not the feedback negative pressurization flag FPTFB (see a step S40) is equal to "1". When this question is first made, FPTFB=0 holds, and then it is determined at a step S34 whether or not the value of the timer tmPRGTANK started at the step S14 in FIG. 2A is equal to "0". So long as tmPRGTANK>0 holds, the program proceeds to a step S35. After the feedback negative pressurization flag FPTFB is set to "1" at the step S40, the program jumps from the step S33 to the step S35.

At the step S35, the bypass valve 24 is kept open, the vent shut valve is closed, and the purge control valve 30 is opened, to thereby execute negative pressurization of the fuel tank (open-loop negative pressurization). At this time, the valve-opening duty ratio of the purge control valve 30 is controlled so as to be progressively decreased with the lapse of time. At a step S51 in FIG. 3B, it is determined whether or not the feedback negative pressurization flag FPTFB is equal to "1". If FPTFB=0 holds, i.e. when the open-loop negative pressurization is being executed, it is determined at a step S52 whether or not the tank internal pressure PTANK is higher than a predetermined lower limit value POBJL (e.g. –30 mmHg). When this question is first made, PTANK>POBJL holds, and then the program proceeds to a step S41, wherein it is determined whether or not the difference (PATM–PTANK) between the atmospheric pressure PATM and the tank internal pressure PTANK is smaller than a predetermined value DPURGOK (e.g. –3 mmHg). When this question is first made, (PATM–PTANK) <DPURGOK holds, and therefore the program is immediately terminated. On the other hand, if the PTANK value falls so that (PATM–PTANK)≧DPURGOK holds, a negative pressurization OK flag FPURGOK is set to "1" at a step S42, followed by terminating the present routine.

On the other hand, if the PTANK value falls so that PTANK≦POBJL holds at the step S52, the program proceeds to a step S40, wherein the feedback negative pressurization permission flag FPTFB is set to "1", the timer tmPRGTANK is set to a predetermined feedback negative pressurization time period TPRGFB and started, and a down-counting timer tmPFB is set to a predetermined time period TPFB and started, followed by terminating the present routine.

On the other hand, if the predetermined time period TPRGOP has elapsed so that tmPRGTANK=0 holds before PTANK<POBJL holds, the program proceeds from the step S34 to a step S36, wherein it is determined whether or not the negative pressurization OK flag FPURGOK is equal to "1".

Figure 4A:
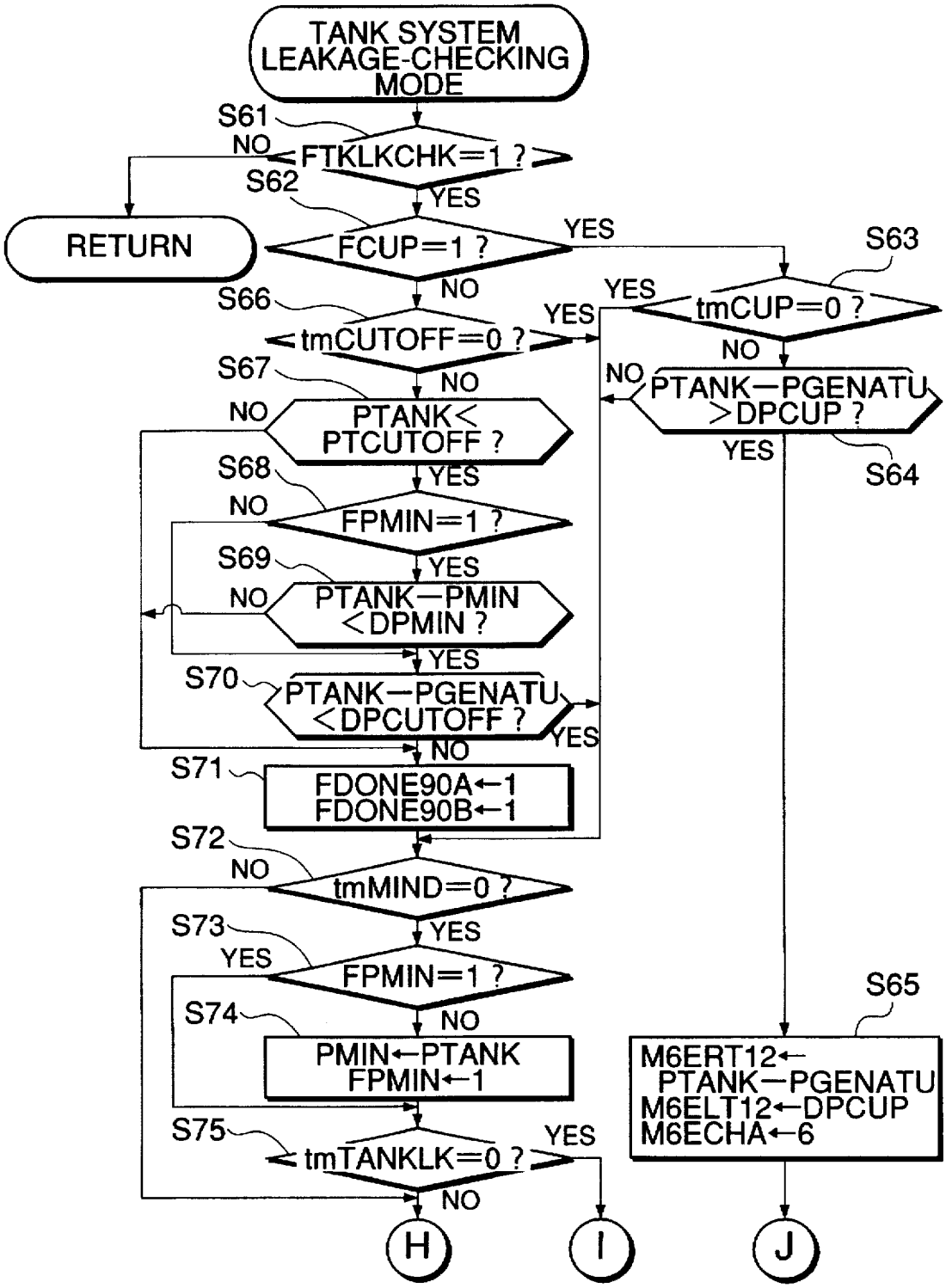
FIG. 4A is a flowchart showing a subroutine for carrying out leakage-checking mode processing of the tank system, which is executed at a step S23 in FIG. 2B.

If FPURGOK=0 holds, i.e. if negative pressurization can hardly be carried out, which means that PATM–PTANK<DPURGOK holds, a down-counting timer tmTANKLK, referred to at a step S75 in FIG. 4A (tank system leakage-checking mode processing), is set to "0" at a step S37. Then, the tank system negative pressurization mode flag FPTDEC is set to "0" and at the same time the tank system leakage-checking mode flag FTKLKCHK is set to "1" at a step S50, followed by terminating the present routine. That is, if tmPRGTANK=0 holds at the step S34 and then FPURGOK=0 holds at the step S36, the tank system negative pressurization mode processing is immediately terminated, and the tank system leakage-checking mode processing is executed. In the tank system leakage-checking mode processing, it is immediately determined that the tank system cannot be negatively pressurized and hence has an abnormality, followed by terminating the tank system abnormality determination (FIG. 4A, step S75→FIG. 4C, steps S101→S102→S109→S111).

If FPURGOK=1 holds at the step S36, the program proceeds to the step S40, and then the feedback negative pressurization is carried out. In the feedback negative pressurization, the purge control valve 30 is duty-controlled so that the pressure sensor output PTANK falls within a range between predetermined upper and lower limit values, whereby the actual tank internal pressure is progressively brought to a desired negative pressure value at the step S35.

If the feedback negative pressurization flag FPTFB=1 holds, the program proceeds from the step S51 to a step S43, wherein it is determined whether or not the absolute value of a rate of change DPTANK in the pressure sensor output (a present value of the PTANK value—a last value of the PTANK value) is smaller than a predetermined rate of change CUTOFFG (e.g. 9.8 mmHg). If |DPTANK|≧CUTOFFG holds, the tank system-monitoring completion flag FDONE90A is set to "1" at a step S44, which means that the tank system abnormality determination is not to be carried out in subsequent loops of execution of the routine, followed by the program proceeding to a step S45. On the other hand, if |DPTANK|<CUTOFFG holds, the program skips over the step S44 to the step S45.

According to the steps S43 and S44, if the rate of change DPTANK in the PTANK value during the negative pressurization is larger than the predetermined rate of change CUTOFFG, it is determined that the float valve 46 is closed during the negative pressurization, and therefore the tank system-monitoring completion flag FDONE90A is set to "1". As a result, the tank system abnormality determination is not carried out in subsequent loops, to thereby prevent a misjudgment due to closure of the float valve 46 during the negative pressurization.

At the step S45, it is determined whether or not the value of the timer tmPFB started at the step S40 is equal to "0". So long as tmPFB>0 holds, it is determined at a step S46 whether or not the value of the timer tmPRGTANK is equal to "0". If tmPRGTANK>0 holds, the program is immediately terminated. The timer tmPFB is set to the predetermined time period TPFB and started also in a processing, not shown, which controls the duty ratio of the purge control valve 30, and when the predetermined time period TPFB has elapsed from the time the pressure sensor output PTANK is determined to be almost equal to the actual tank internal pressure, tmPFB=0 holds.

If tmPFB=0 holds before the value of the timer tmPRGTANK becomes equal to "0", it is determined that the interior of the fuel tank is in a predetermined negatively pressurized state (the negative pressurization has been completed), and then the tank system negative pressurization completion flag FTANKGEN is set to "1" at the step S49, followed by terminating the present routine.

On the other hand, if tmPRGTANK=0 holds before the value of the timer tmPFB becomes equal to "0", the program proceeds from the step S46 to a step S47, wherein a negative pressurization incompletion flag FCUP which, when set to "1", indicates that the predetermined time period TPRGFB has elapsed before the completion of the negative pressurization, is set to "1". Then, a down-counting timer tmCUP is set to a predetermined time period TCUP (e.g. 2 sec) and started at a step S48, followed by the program proceeding to the step S49.

If the negative pressurization completion flag FTANKGEN is set to "1", the program proceeds from the step S32 to a step S38, wherein the pressure sensor output PTANK is stored as negative pressurization completion pressure PGENATU. Then, down-counting timers tmCUTOFF, tmMIND, tmPLKHLD and tmTANKLK are set, respectively, to predetermined time periods TCUTOFF (e.g. 2 sec), TMIND (e.g. 0.5 sec), TPLKHLD (e.g. 8 sec) and TTANKLK (e.g. 25.5 sec), and started at a step S39, followed by the program proceeding to the step S50.

Figure 4B:
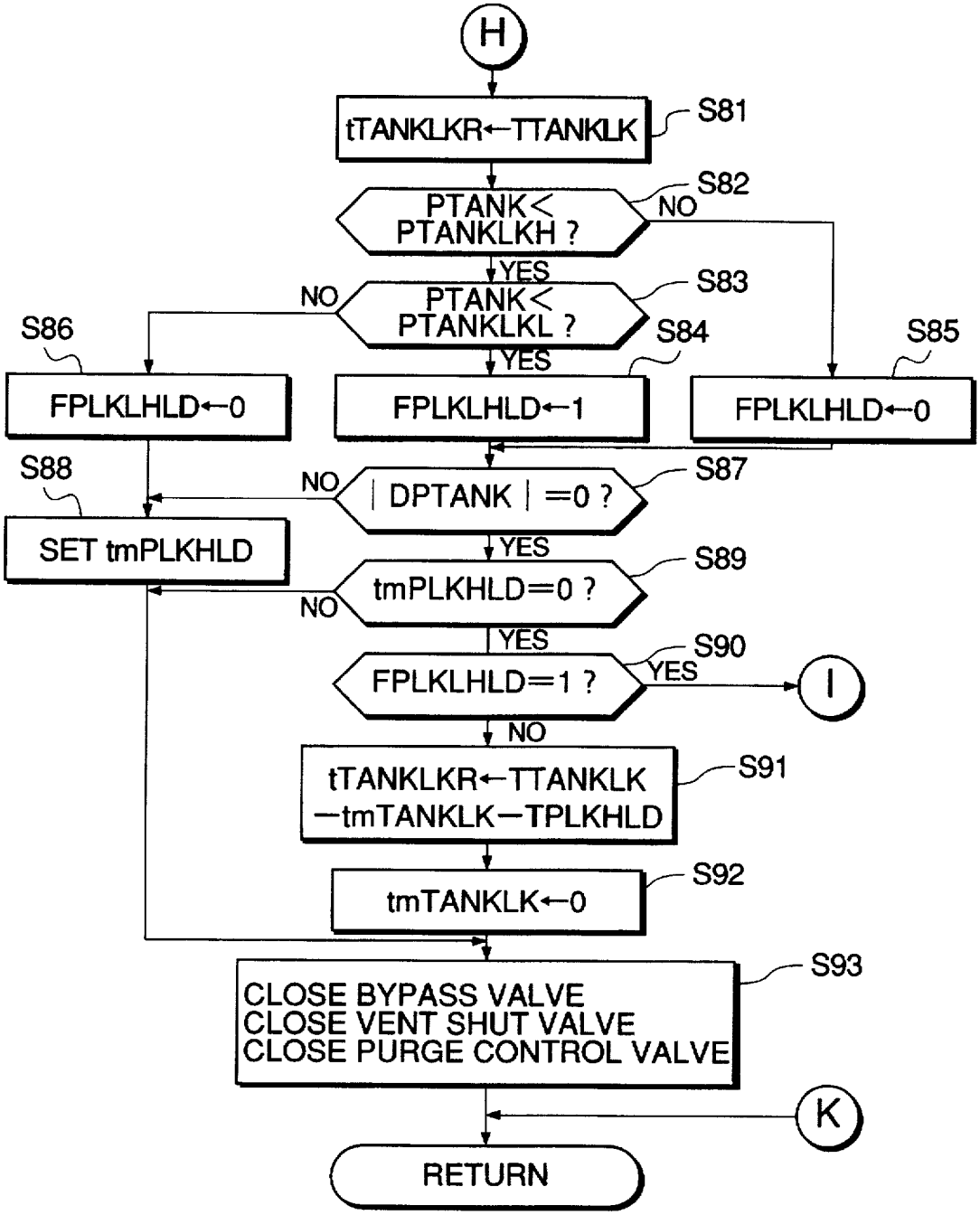
FIG. 4B is a continued part of the flowchart of FIG. 4A.
Figure 4C:
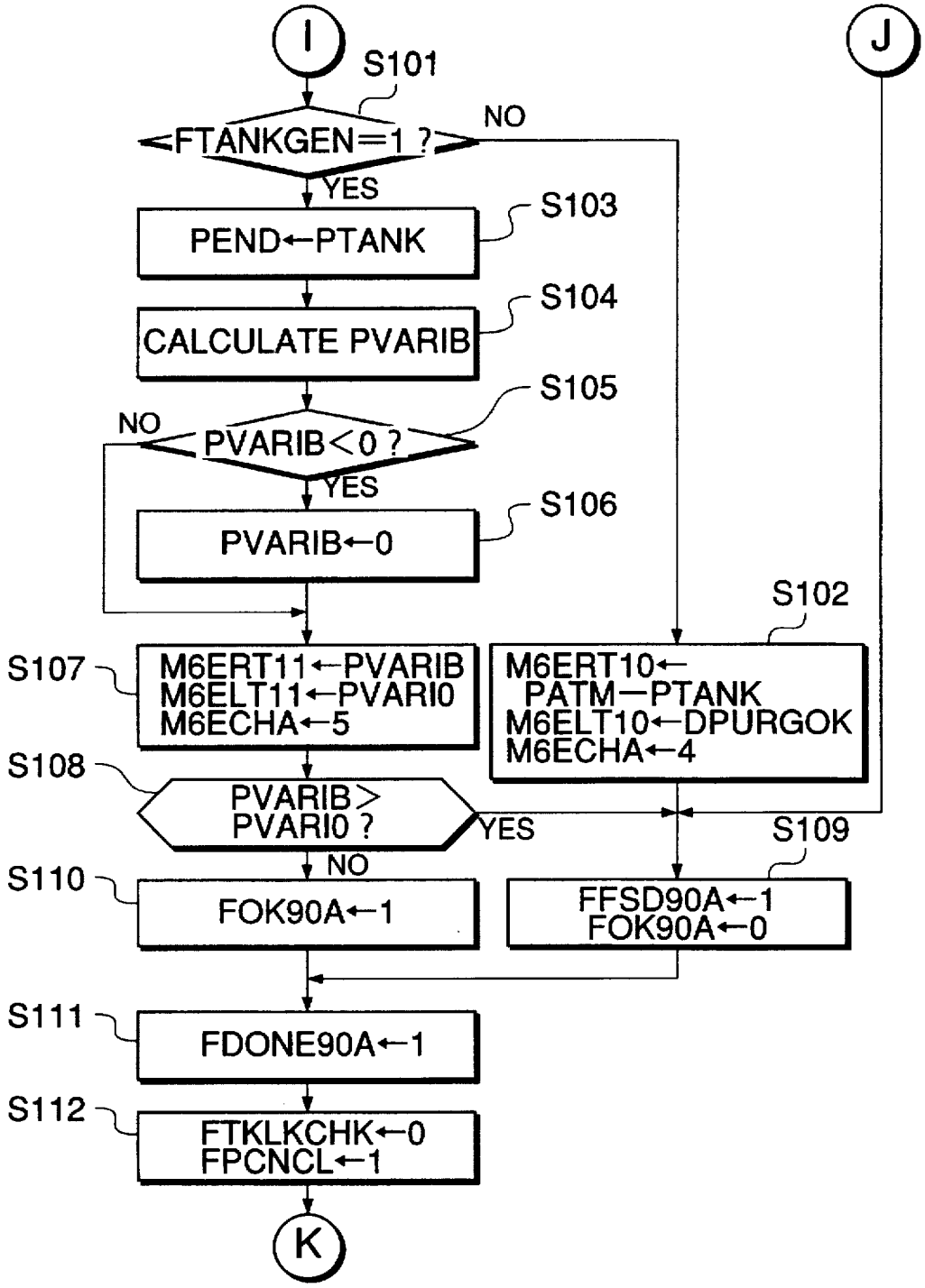
FIG. 4C is a continued part of the flowchart of FIG. 4B.

FIGS. 4A to 4C collectively show a subroutine for carrying out the tank system leakage-checking mode processing executed at the step S23 in FIG. 2B.

At a step S61 in FIG. 4A, it is determined whether or not the tank system leakage-checking flag FTKLKCHK is equal to "1". If FTKLKCHK=0 holds, the program is immediately terminated. On the other hand, if FTKLKCHK=1 holds, it is determined at a step S62 whether or not the negative pressurization incompletion flag FCUP is equal to "1". If FCUP=0 holds, it is determined at a step S66 whether or not the value of the timer tmCUTOFF started at the step S39 in FIG. 3A is equal to 0. When this question is first made, tmCUTOFF>0 holds, and then it is determined at a step S67 whether or not the tank internal pressure PTANK is lower than a predetermined value PTCUTOFF (e.g. −1 mmHg). Normally, PTANK<PTCUTOFF holds, and then the program proceeds to a step S68, wherein it is determined whether or not an initial pressure-storing flag FPMIN is equal to "1". The flag FPMIN, when set to "1", indicates that the pressure sensor output PTANK assumed upon the lapse of the predetermined time period TMIND from completion of the negative pressurization (FIGS. 3A and 3B) has been stored as initial pressure PMIN (see a step S74). When this question is first made, FPMIN=0 holds, and then the program proceeds from the step S68 to a step S70, wherein it is determined whether or not the difference (PTANK−PGENATU) between the pressure sensor output PTANK and the negative pressurization completion pressure PGENATU is smaller than a predetermined value DPCUTOFF (e.g. 13.7 mmHg).

Figure 5A:
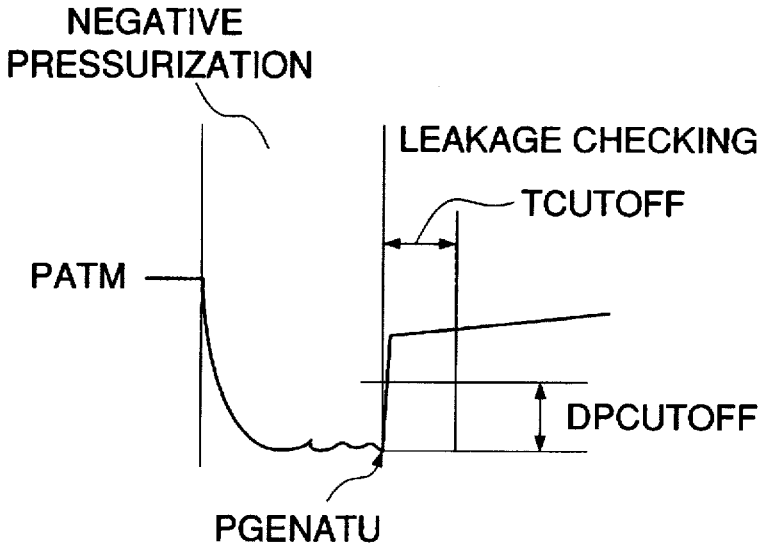
FIG. 5A is a timing chart which is useful in explaining a manner of abnormality determination of the tank system.

If (PTANK−PGENATU)<DPCUTOFF holds, the program jumps to a step S72. On the other hand, if (PTANK−PGENATU)≧DPCUTOFF holds, the internal tank pressure has largely increased immediately after the start of the leakage-checking (see FIG. 5A). Therefore, it is determined that the float valve 46 has been closed (even before the start of the negative pressurization), and the tank system-monitoring completion flag FDONE90A and the canister system-monitoring completion flag FDONE90B are both set to "1" at a step S71, followed by the program proceeding to the step S72. Thus, if the float valve 46 has been closed even before the start of the tank system negative pressurization, the abnormality determination is inhibited in subsequent loops, to thereby prevent a misjudgment that the tank system is abnormal in spite of the fact that the tank system is normal.

If PTANK≧PTCUTOFF holds before the value of the timer tmCUTOFF becomes equal to "0", i.e. if the answer to the question of the step S67 is negative (NO), or if the difference (PTANK−PMIN) between the pressure sensor output PTANK and the initial pressure PMIN becomes larger than a predetermined value DPMIN (e.g. 3 mmHg), i.e. if the answer to the question of a step S69 is negative (NO), the step S71 is also executed, and the abnormality determination is inhibited in subsequent loops. The determination at the step S69 is provided by the following reason: That is, in the event that the flow rate of evaporative fuel through the purge control valve 30 assumed during opening thereof decreases, (PTANK−PGENATU)≧DPCUTOFF does not always hold at the step S70 even if the float valve 46 is closed. By virtue of the determination at the step S69, closure of the float valve 46 in such an event can be detected. Therefore, if (PTANK−PMIN)≧DPMIN holds within the predetermined time period TCUTOFF, it is determined that the float valve 46 is closed, to thereby inhibit the abnormality determination in subsequent loops.

If the value of the timer tmCUTOFF becomes equal to "0", the program skips over the step S66 to the step S72.

At the step S72, it is determined whether or not the value of the timer tmMIND is equal to "0". When this question is first made, tmMIND>0 holds, and then the program jumps to a step S81 in FIG. 4B, whereas if tmMIND=0 holds, it is determined at a step S73 in FIG. 4A whether or not the initial pressure-storing flag FPMIN is equal to "1". When this question is first made, FPMIN=0 holds, and therefore the pressure sensor output PTANK assumed at this time is stored as the initial pressure PMIN. Then, the initial pressure-storing flag FPMIN is set to "1" at the step S74, followed by the program proceeding to the step S75. In subsequent loops of execution of the routine, the program skips over the step S73 to the step S75.

At the step S75, it is determined whether or not the value of the timer tmTANKLK which was set to the predetermined leakage-checking time period TTANKLK is equal to "0". So long as tmTANKLK>0 holds, the program proceeds to the step S81 in FIG. 4B.

At the step S81, a variation rate-calculating time period tTANKLKR which constitutes a denominator of an equation for calculating a rate of variation PVARIB, referred to hereinafter, is set to the leakage-checking time period TTNKLK, and it is determined at a step S82 whether or not the pressure sensor output PTANK is lower than a first predetermined negative pressure value PTANKLKH (e.g. −5 mmHg). If PTANK<PTANKLKH holds, it is determined at a step S83 whether or not the PTANK value is lower than a second predetermined negative pressure value PTANKLKL (e.g. −10 mmHg) which is lower than the first predetermined negative pressure value PTANKLKH. If PTANK≧PTANKLKH holds at the step S82, a variation rate-calculating time period-changing flag FPLKLHLD which, when set to "0", indicates that the variation rate-calculating time period tTANKLKR is to be changed, is set to "0" at a step S85. On the other hand, if PTANK<PTANKLKL holds at the step 83, the variation rate-calculating time period-changing flag FPLKLHLD is set to "1" at a step S84, followed by the program proceeding to a step S87.

On the other hand, if the answer to the question of the step S82 is affirmative (YES) and at the same time the answer to the question of the step S83 is negative (NO), i.e. if PTANKLKL≦PTANK<PTANKLKH holds, the variation rate-calculating time period-changing flag FPLKLHLD is set to "0" at a step S86, and the timer tmPLKHLD (see the step S39 in FIG. 3A), referred to at a step S89, is set to the predetermined time period TPLKHLD and started at a step S88, followed by the program proceeding to a step S93.

At the step S87, it is determined whether or not the absolute value of the rate of change DPTANK in the pressure sensor output PTANK is equal to "0". If |DPTANK|>0 holds, the program proceeds to the step S88. On the other hand, if |DPTANK|=0 holds at the step S87, it is determined at the step S89 whether or not the value of the timer tmPLKHLD is equal to "0". So long as tmPLKHLD>0 holds, the program jumps to the step S93, whereas if tmPLKHLD=0 holds, it is determined at a step S90 whether or not the variation rate-calculating time period-changing flag FPLKLHLD is equal to "1". If FPLKLHLD=1 holds, i.e. if PTANK<PTANKLKL holds and at the same time |DPTANK|=0 has held over the predetermined time period TPLKHLD, the program proceeds to a step S101 in FIG. 4C. On the other hand, if FPLKLHLD=0 holds, the variation rate-calculating time period tTANKLKR is changed at a step S91, by the use of the following equation (2):

$$tTANKLKR=TTANKLK-tmTANKLK-TPLKHLD \quad (2)$$

where tmTANKLK represents a value of the timer tmTANKLK assumed at this time. The reason for changing the time period tTANKLKR is that a time period over which the PTANK value has actually changed (time period obtained by subtracting a time period over which the PTANK value is constant from the TTANKLK value) is set as the denominator of the change rate-calculating equation. If FPLKLHLD=1 holds, it is assumed that there is no leakage from the tank system, which means that there is no problem even if the rate of variation PVARIB is smaller than an actual value thereof, and therefore tTANKLKLR=TTANKLK is maintained as it is.

At the following step S92, the value of the timer tmTANKLK is set to "0", followed by the program proceeding to the step S93. At the step S93, the vent shut valve 26 is kept closed, and the bypass valve 24 and the purge control valve 30 are closed, followed by terminating the present routine. When the predetermined time period TTANKLK has elapsed from the start of the leakage checking, the program proceeds from the step S75 to the step S101 in FIG. 4C.

At the step S101, it is determined whether or not the tank system negative pressurization completion flag FTANKGEN is equal to "1". If FTANKGEN=0 holds, which means that the tank system has failed to be negatively pressurized to a sufficient degree (i.e. if the program has proceeded from the step S36 through the step S37 in FIG. 4A to the step S50 in FIG. 4B), the program proceeds to a step S102, wherein a result parameter M6ERT10 and a reference parameter M6ELT10 are set to the pressure difference (PATM-PTANK) and the predetermined value DPURGOK (see the step S41 in FIG. 4B) and at the same time a tank system-checking parameter M6ECHA is set to "4". M6ECHA=4 indicates that the tank system has failed to be negatively pressurized. Possible causes for failure of the tank system to be negatively pressurized include slipping-off of a pipe of the system, abnormality in the output from the pressure sensor 11, and failure of the bypass valve 24 to open. The parameters M6ERT10, M6ELR10 and M6ECHA are referred to in other processings, not shown.

Then, at a step S109, a tank system abnormality flag FFSD90A which, when set to "1", indicates that the tank system is abnormal, is set to "1" and at the same time a tank system normality flag FOK90A which, when set to "1", indicates that the tank system is normal, is set to "0". Then, the tank system-monitoring completion flag FDONE90A is set to "1" at a step S111, and further the tank system leakage-checking flag FTKLKCHK is set to "0" and the pressure-recovering mode flag FPCNCL is set to "1" at a step S112, followed by terminating the present routine.

If FTANKGEN=1 holds at the step S101, which means that the tank system has been negatively pressurized, the pressure sensor output PTANK assumed at this time is stored as completion pressure PEND at a step S103, followed by calculating the rate of variation PVARIB at a step S104, by the use of the following equation (3):

$$PVARIB=(PEND-PMIN)/tTANKLKR \quad (3)$$

Then, it is determined at a step S105 whether or not the rate of variation PVARIB is negative. If PVARIB<0 holds, the rate of variation PVARIB is set to "0" at a step S106, whereas if PVARIB≧0 holds, the program skips to a step S107.

At the step S107, a result parameter M6ERT11 and a reference parameter M6ELT11 are set, respectively, to the rate of variation PVARIB and a predetermined rate of variation PVARI0 (see a step S108) and at the same time the tank system-checking parameter M6ECHA is set to "5", followed by the program proceeding to the step S108. M6ECHA=5 indicates completion of the tank system leakage checking. These parameters M6ERT11, M6ELR11, and M6ECHA are referred to in other processings, not shown.

At the step S108, it is determined whether or not the rate of variation PVARIB is larger than the predetermined rate of variation PVARI0, and if PVARIB>PRARI0 holds, it is determined that the tank system is abnormal, and the program proceeds to the step S109.

On the other hand, if PVARIB≦PRARI0 holds, the tank system OK flag FOK90A is set to "1" at a step S110, followed by the program proceeding to the step S111.

Referring again to FIG. 4A, if FCUP=1 holds at the step S62, which means that the feedback negative pressurization has not been completed within the predetermined time period TPRGFB, it is determined at a step S63 whether or not the value of the timer tmCUP is equal to "0". So long as tmCUP>0 holds, it is determined at a step S64 whether or not the difference (PTANK–PGENATU) between the pressure sensor output PTANK and the negative pressurization completion pressure PGENATU is larger than a predetermined value DPCUP (e.g. 8.8 mmHg). If (PTANK–PGENATU)>DPCUP holds, it is determined that a large amount of leakage such as slipping-off of the filler cap 42 has occurred in the tank system, and then a result parameter M6ERT12 and a reference parameter M6ELT12 are set, respectively, to the pressure difference (PTANK–PGENATU) and the predetermined value DPCUP, and at the same time the tank system-checking parameter ME6CHA is set to "6" at a step S65, followed by the program proceeding to the step S109 in FIG. 4C. ME6CHA=6 indicates that the tank system has a large amount of leakage. These parameters M6ERT12, M6ELR12, and M6ECHA are referred to in other processings, not shown.

At the step S64, if (PTANK–PGENATU)≦DPCUP holds, or if the predetermined time period TCUP has elapsed, the program proceeds to the step S72.

Figure 5B:
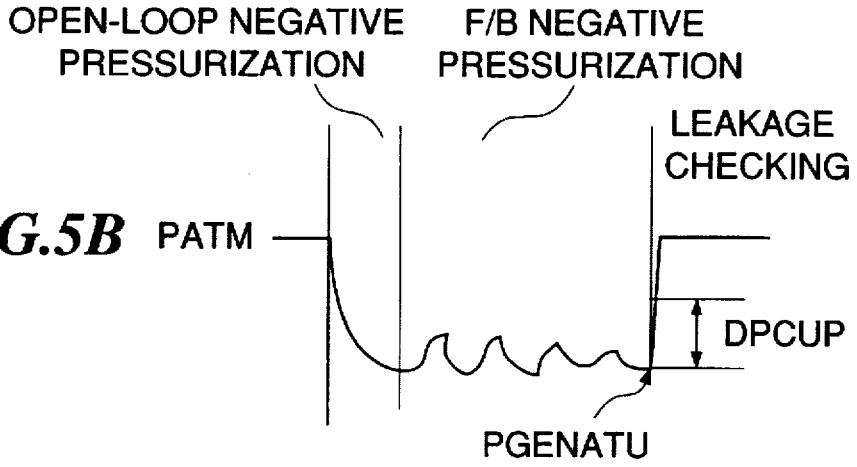
FIG. 5B is a timing chart which is also useful in explaining the manner of the abnormality determination of the tank system, according to the second embodiment.
Figure 5C:
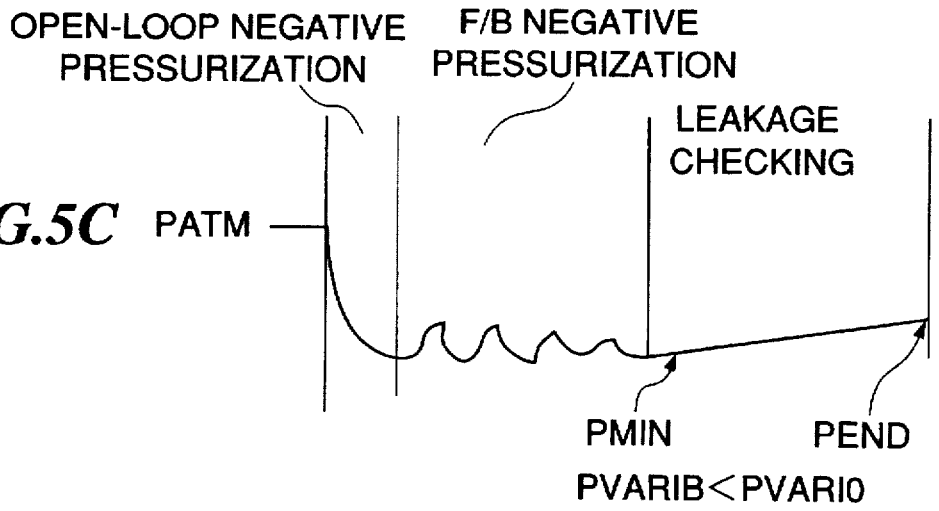
FIG. 5C is a timing chart which is also useful in explaining the manner of the abnormality determination of the tank system.

According to the steps S62, S63 and S64 and the step S72 et seq., even if the negative pressurization of the tank system has not been completed within the predetermined time period (i.e. if FCUP=0 holds), the tank system leakage checking is carried out. As a result, even if the rate of negative pressurization within the fuel tank deceases due to aging deterioration of the purge control valve or the like, accurate abnormality determination of the fuel tank can be carried out. That is, if the pressure difference between the pressure sensor output PTANK and the pressure sensor output PGENATU assumed at the completion of the negative pressurization (immediately before closure of the bypass valve 24) exceeds the predetermined value DPCUP within the predetermined time period TCUP after the start of the leakage-checking mode processing, it is determined that abnormality (a large amount of leakage) exists in the tank system (steps S64→S65, and FIG. 5B), whereby an abnormality or a large amount of leakage which has prevented completion of the negative pressurization within the predetermined time period can be detected with accuracy. Further, if the rate of negative pressurization of the tank internal pressure decreases simply due to aging deterioration of the purge control valve, the step S72 et seq. are executed. In this case, if the tank system is normal, PVARIB≦PVARI0 holds (see FIG. 5C), and therefore the determination as to normality of the tank system can be carried out as well with accuracy.

Referring again to FIG. 2B, at the following step S25, it is determined whether or not the pressure-recovering mode flag FPCNCL or the correction-checking mode flag FPTREV is equal to "1". FPCNCL=FPTREV=0 holds until the tank system leakage-checking mode is completed, and therefore the tank system pressure-recovering timer tmPTCNCL is set to a predetermined time period TPTCNCL (e.g. 0.1 sec) and started at the step S26, followed by the program proceeding to the step S27. On the other hand, if the tank system leakage-checking mode has been completed, the pressure-recovering mode flag FPCNCL is set to "1", and then the program skips over the step S25 to the step S27.

At the step S27, the pressure-recovering mode processing is executed. More specifically, the bypass valve 24 is kept open, the purge control valve 30 is kept closed, and the purge control valve 30 is closed, to thereby introduce air into the canister system and the tank system. Then, the tank system abnormality determination is carried out based on the mode of a change in the tank internal pressure PTANK. If abnormality or normality of the tank system is finally determined, the program is immediately terminated without executing the correction-checking mode processing. On the other hand, if no abnormality or normality of the same is finally determined, the pressure-recovering mode flag FPCNCL is set to "0", and the correction-checking mode flag FPTREV is set to "1", followed by the program proceeding to the correction-checking mode processing.

At the step S28, the correction-checking mode processing is executed. More specifically, the vent shut valve 26 is kept open, the purge control valve 30 is kept closed, and the bypass valve 24 is closed, to thereby detect a rate of variation PVARIC in the PTANK value over a predetermined time period. Then, a comparison is made between the rate of increase PVARIB detected at the step S23 and the rate of variation PVARIC detected at the step S28, to thereby execute the tank system abnormality determination.

After the execution of the step S28, the present program is terminated.

According to the present embodiment, the processing of FIGS. 2A and 2B is executed at predetermined time intervals after an ignition switch of the engine is turned on. Once the above described series of determinations (from the step S14 to the step S28) have been executed to finally determine abnormality or normality of the emission control system, however, the abnormality determination is no more executed. Thereafter, when the engine is stopped and then started again, the determinations are executed once. That is, the determinations are executed once over one operation period of the engine from the time the ignition switch is turned on to start the engine to the time the engine is stopped. Further, if the tank system-monitoring completion flag FDONE90A is set to "1" during execution of the abnormality determination, the tank system abnormality determination is not executed any more during the present operation period. On the other hand, if the canister system-monitoring completion flag FDONE90B is set to "1" during execution of the abnormality determination, the canister system abnormality determination is not executed any more during the present operation period. In the present embodiment, if the determination that the tank system or the canister system is abnormal is consecutively made over two operation periods of the engine, an alarm is issued to the driver.

What is claimed is:

1. In an evaporative fuel-processing system for an internal combustion engine having a fuel tank, and an intake system, including a canister for adsorbing evaporative fuel generated in said fuel tank, a charging passage extending between said canister and said fuel tank, a purging passage extending between said canister and said intake system, an open-to-atmosphere passage for relieving an interior of said canister to atmosphere, a charge control valve for opening and closing said charging passage, a purge control valve for opening and closing said purging passage, a vent shut valve for opening and closing said open-to-atmosphere passage, and a pressure sensor arranged in said charging passage on a side of said charge control valve closer to said fuel tank, for detecting pressure within said charging passage, the improvement comprising:

negatively pressurizing means operable when said engine is in a predetermined operating condition, for negatively pressurizing an interior of said fuel tank into a predetermined negatively pressurized state by opening said purge control valve and said charge control valve and closing said vent shut valve; and abnormality-determining means operable when a predetermined time period has elapsed from the start of said negative pressurization before said interior of said fuel tank is set to said predetermined negatively pressurized state, for closing said purge control valve and said charge control valve, and determining an abnormality of said fuel tank, based on said pressure within said charging passage detected by said pressure sensor immediately before and after said closing of said purge control valve and said charge control valve.

2. An evaporative fuel-processing system as claimed in claim 1, wherein said abnormality-determining means determines that said fuel tank is abnormal when said pressure within said charging passage detected by said pressure sensor has increased by a predetermined amount or more from a value thereof detected by said pressure sensor immediately before said closing of said purge control valve and said charge control valve, within a second predetermined time period from said closing of said purge control valve and said charge control valve.

3. An evaporative fuel-processing system as claimed in claim 1, wherein said abnormality-determining means determines an abnormality of said fuel tank, based on a rate of change in said pressure within said charging passage detected by said pressure sensor over a third predetermined time period, when no abnormality of said fuel tank has been detected.

* * * * *